United States Patent [19]

Foldes

[11] 4,095,353

[45] Jun. 20, 1978

[54] MASSAGE SANDAL

[75] Inventor: Peter Andrew Foldes, Conyngham, Pa.

[73] Assignee: Oggs Manufacturing Corp., Hazleton, Pa.

[21] Appl. No.: 794,220

[22] Filed: May 5, 1977

[51] Int. Cl.[2] ..... A43B 3/12; A43B 13/38

[52] U.S. Cl. ..... 36/11.5; 36/43

[58] Field of Search ..... 36/11.5, 32 R, 59 R, 36/59 C, 43

[56] References Cited

U.S. PATENT DOCUMENTS

| | | | |
|---|---|---|---|
| 2,758,395 | 8/1956 | Miyaji | 36/11.5 |
| 3,360,633 | 12/1967 | Weisberger | 36/11.5 |
| 3,595,244 | 7/1971 | Kugler | 36/11.5 |
| 3,722,113 | 3/1973 | Birkenstock | 36/11.5 |
| 3,859,727 | 1/1975 | Nakamoto | 36/11.5 |

*Primary Examiner*—Patrick D. Lawson

*Attorney, Agent, or Firm*—Jackson and Chovanes

[57] ABSTRACT

A one-piece molded flexible plastic or rubber sandal having integrally molded on the insole thereof a plurality of highly flexible, closely spaced, relatively long, thin points which flex substantially under the weight of the bare foot of the sandal wearer whereby the points massage the sole of the wearer under a walking motion or other movement of the foot.

2 Claims, 4 Drawing Figures

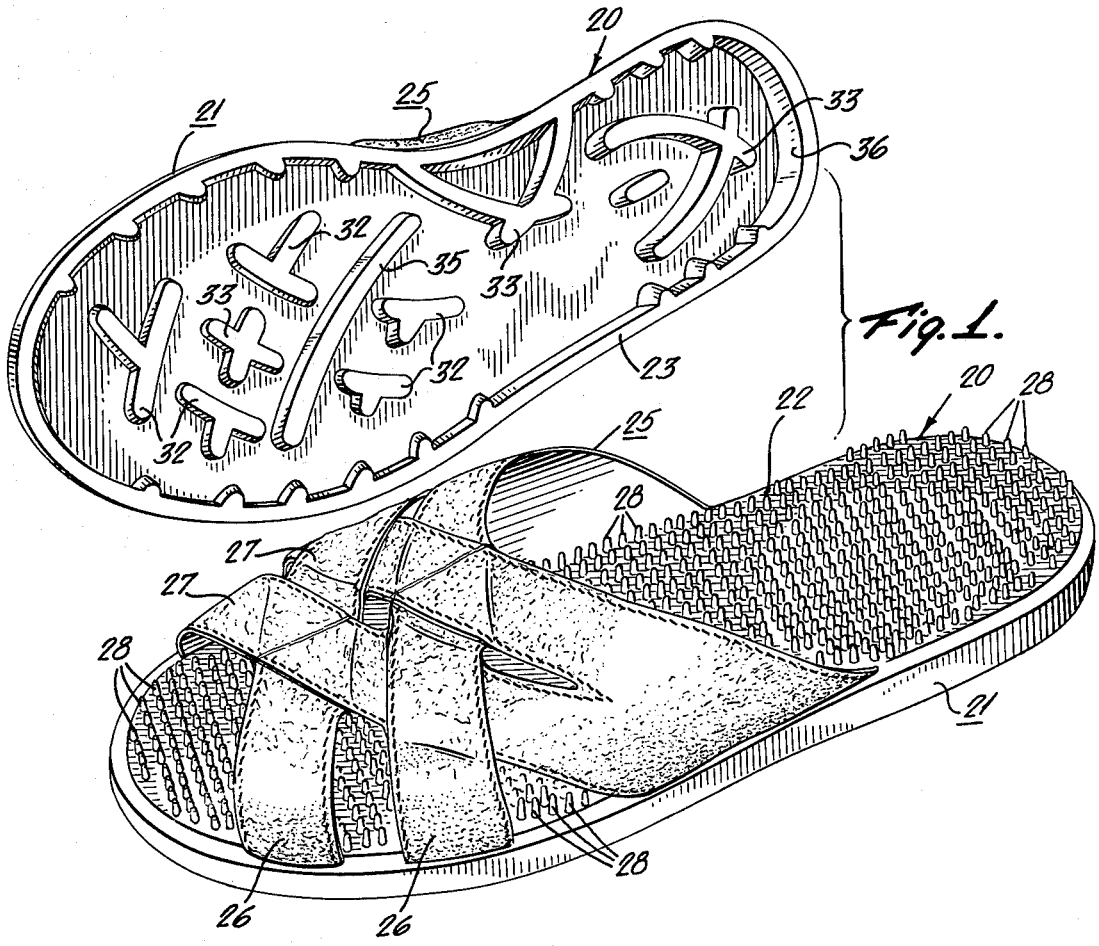
Fig. 2.
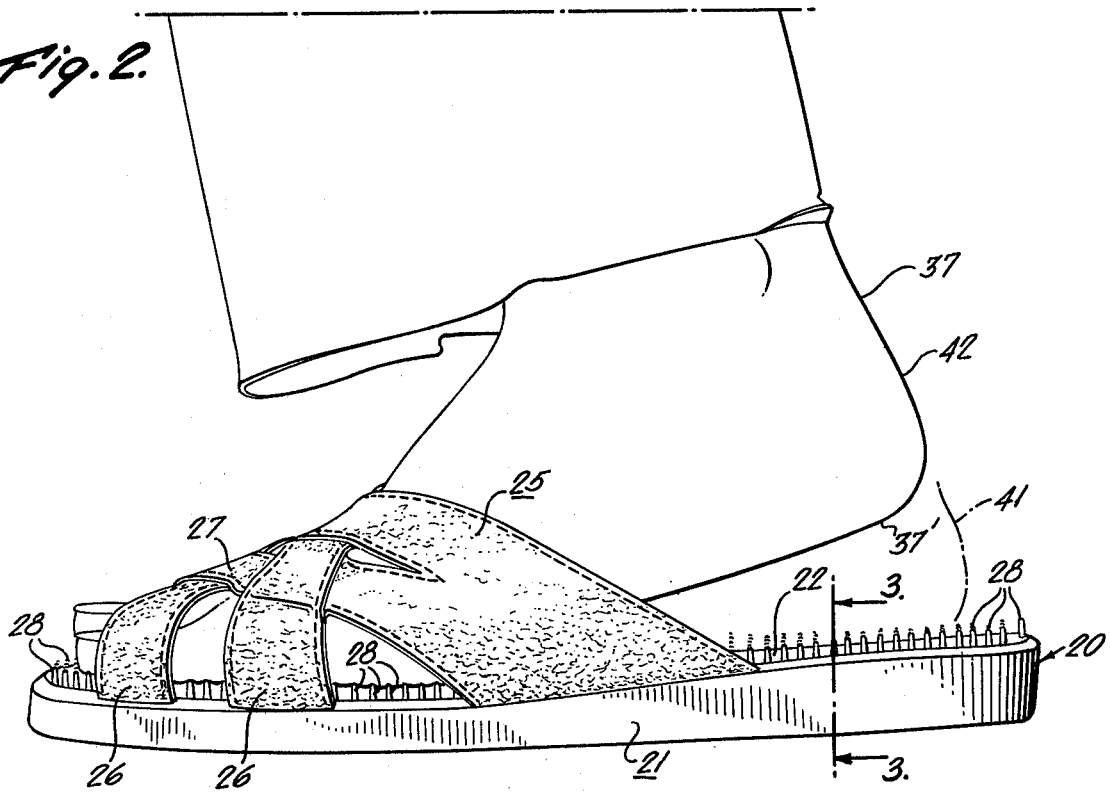

MASSAGE SANDAL

BACKGROUND OF INVENTION

Sandals, of the open type, have been worn for centuries, primarily for their comfort to the wearer. Such sandals consist essentially of a relatively flat sole portion and an upper strap or thong arrangement to secure the sole portion to the foot of the wearer. The sole portions have been of rigid material such as wood and flexible material such as leather or rubber. The innersole or top of the sole portions has in some instances affixed thereto, or integral with, a flexible or cushion material such as foam sponge layer, or a felt layer.

PRIOR ART

In one embodiment of a prior art sandal, the innersole has molded knobs of relatively rigid composition which support the foot and which provide pressure points on which the sole of the foot is supported. The knobs are short, and relatively squat, and form platforms to support the foot.

SUMMARY OF PRESENT INVENTION

In the present invention, a series of very flexible, relatively thin points are molded into the flexible sole of a sandal. These flexible points, as distinct from the prior art innersoles, including the prior art innersole having molded knobs of relatively rigid composition thereon, provide a very active and substantial massage effect when the sandal is used by a wearer. Such substantial massage effect results from continuous movement of the points under the influence of a wearer's walking motion or other movement of the foot.

The flexible points readily are deflected over on to their side in diverse and wanton directions when force is applied by the foot. Subsequently, when the foot is lifted, the flexible points spring back into an upright position, resulting in a massage effect both when the points are deflected downwardly as force is applied, and when the points spring back to their upright position when force is removed. These flexible points in effect give a stroking motion to the minute, limited area with which the points are in contact with the foot. The points are spaced very closely together, for instance 36 points per square inch. The points are, for instance, 0.20 inches high and 0.09 inches in thickness at the base and tapering to a diameter of 0.05 inches at the top thereof.

The sandal may optionally have a raised portion on the undersole thereof, whereby the sole itself is raised above the ground.

DESCRIPTION OF THE INVENTION

FIG. 1 is a perspective view of the sandal of the invention showing the bottom sole in the upper portion of FIG. 1, and the inner sole as well as the flexible straps, at the bottom portion of the figure.

FIG. 2 is a left-side elevation of the sandal being worn by a user, with the user's foot being inclined in a forward direction.

DESCRIPTION OF THE PREFERRED EMBODIMENT

Figure 3:
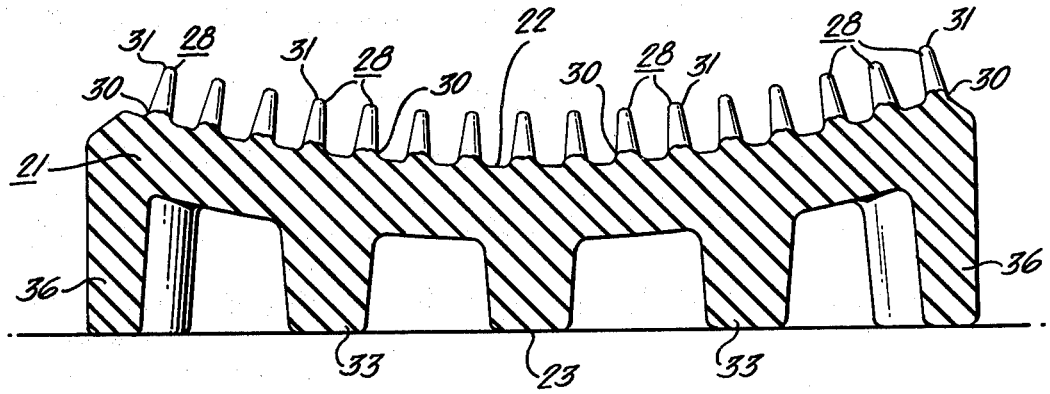
FIG. 3 is a sectional elevational view taken on the line 3—3 of FIG. 2.

As seen in FIG. 1, a massage sandal 20 has a sole portion 21 having an inner sole 22 and a bottom sole 23. Attached to sole portion 21 are the upper retaining straps 25 having diagonal closing straps 26 and 27. The entire sandal is suitably molded in one piece out of a flexible material such as rubber or polyurethane.

Molded integrally on the inner sole are a series of flexible points 28 formed in tapering fashion, having a wider base at 30 and a narrower apex at 31. The configuration of the point is such that it is highly flexible and in flex substantially under the weight of a user. A suitable dimension of the point is one having a base diameter of 0.09 inches, an apex diameter of 0.05 inches, and a height of 0.20 inches. The points are densely spaced on the inner sole so that numerous points are in contact with the entire sole of the foot. For instance, a suitable density would be 36 points per square inch.

The bottom sole 23 can be of a raised integral portion having a suitable configuration of, for instance "tees" 32, crosses 33, curved lines 35 and a perimeter 36. Such raised portions 23 are selected to provide support points underneath the ball, heel, and arch of the foot of the wearer.

Figure 4:
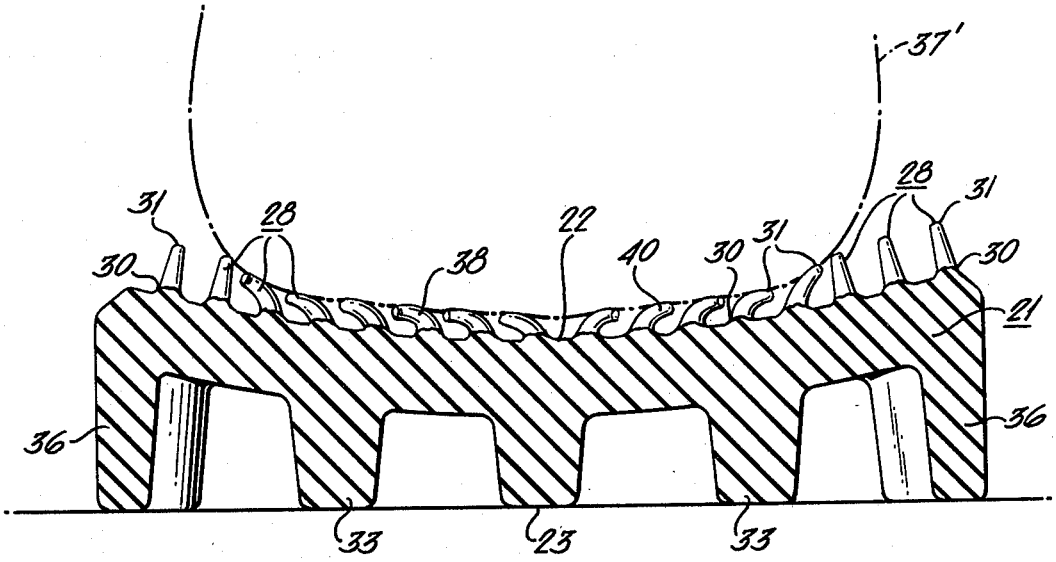
FIG. 4 is a view similar to FIG. 3 showing the foot of a user being supported in a sandal.

In use, the wearer inserts his foot 37 into the confines of the upper straps 25, bringing the sole of his foot into contact with inner sole 22 and the points 28 thereon. The points flex when the wearer puts his weight on the sandal as best seen in FIG. 4 wherein the heel 37 of the wearer causes points 28 to flex in a plurality of directions as seen at 38 and 40 when the wearer relieves his weight from the sandal as seen for instance in FIG. 2 where his heel moves from a downward position as shown in phantom lines 41 to an upward position as seen at 42, the points spring from the flexed position of FIG. 4 to the upright position, as seen under the heel of FIG. 2. Such flexing movement of the points during activity by the wearer results in a constant massage effect of the bare foot of the wearer.

The bottom sole 23 as seen particularly in FIGS. 3 and 4 can be molded of varying heights whereby a concave effect can be achieved on the upper sole, in a transverse direction, as shown in FIGS. 3 and 4. The perimeter 36 is molded of relatively greater height than the portions within the perimeter such as 33 and 34.

In view of my invention and disclosure, variations and modifications to meet individual whim or particular need will doubtless become evident to others skilled in the art, to obtain all or part of the benefits of my invention without copying the structure shown, and I therefore claim all such insofar as they fall within the reasonable spirit and scope of my claims.

Having thus described my invention, what I claim as new and desire to secure by Letters Patent is:

1. A sandal for human wear comprising:

a. a sole portion of flexible material;

b. an inner sole portion integral with the sole portion, wherein the inner sole is formed of a plurality of flexible points cone-shaped having a uniform height in the range of 0.20 inches, a base diameter in the range of 0.09 inches, and a pointed apex, said points extending upwardly from the sole portion and having a density of 36 points per square inch; and c. a top retaining strap portion integral with the sole portion;

wherein the foot of a user when inserted into the sandal beneath the strap portion and into contact with the points of the inner sole, is constantly massaged during foot activity by the user through the action of the flexing of the points of the inner sole.

2. The sandal of claim 1 having a bottom sole portion formed of elevated elements integrally molded with the sole portion, the bottom sole portion having varying heights to form a contoured, concave, sole portion, and inner sole portion.

* * * * *